United States Patent [19]

Cosmos et al.

[11] Patent Number: 4,842,555

[45] Date of Patent: Jun. 27, 1989

[54] CIRCULAR DIN RECEPTACLE COVER FOR LATCHING PLUG

[75] Inventors: Peter Cosmos, Mechanicsburg; William C. Ohl, Harrisburg, both of Pa.

[73] Assignee: AMP Incorporated, Harrisburg, Pa.

[21] Appl. No.: 202,276

[22] Filed: Jun. 3, 1988

[51] Int. Cl.[4] ..... H01R 13/648; H01R 13/627

[52] U.S. Cl. ..... 439/609; 439/353; 174/35 C

[58] Field of Search ..... 439/76, 95, 108, 345, 439/348, 350, 353, 354, 357, 358, 607, 609, 610, 906; 174/35 C

[56] References Cited

U.S. PATENT DOCUMENTS

| | | | |
|---|---|---|---|
| 4,337,989 | 7/1982 | Asick | 339/143 |
| 4,493,525 | 1/1985 | Hall | 339/143 |
| 4,548,455 | 10/1985 | Ezure | 339/45 |
| 4,611,878 | 9/1986 | Hall | 339/186 |
| 4,634,208 | 1/1987 | Hall | 339/143 |
| 4,637,669 | 1/1987 | Tajima | 339/14 |
| 4,695,105 | 9/1987 | Ney | 439/95 |

OTHER PUBLICATIONS

AMP Catalog 83-700, Rev. 10-86.

*Primary Examiner*—Neil Abrams
*Assistant Examiner*—Khiem Nguyen
*Attorney, Agent, or Firm*—David L. Smith

[57] ABSTRACT

A surface mounted electrical connector (10) has a metal shield (12) having a front plate (28) with a circular opening (30) for receiving a shielded socket (18) of a mating connector (20), to allow it to mate with a plug portion (16) of the surface mounted connector (10). Spring fingers (34) project from the edge (32) of the opening (30) for engaging shielding (19) of the mating connector (20). Between a pair of the fingers (34) there also projects form the edge (32), a latching finger (80) which is shorter than the spring fingers (34), for latching behind a depressable protuberance (90) on the socket (18). When the plug portion (16) is to be mated with the socket (18), a flexible arm (98) in the socket (18), which carries the protuberance (90) is supported by a support bar (88) which is stiffly resilient. During mating, the protuberance (90) displaces the latching finger (80) and latches behind its free end (84). A sleeve (100) on the mating connector (20) can be pulled to withdraw the support bar (98) so that the protuberance can slide under the latching finger (80) to allow the connectors (10 and 20) to be unmated.

10 Claims, 2 Drawing Sheets

CIRCULAR DIN RECEPTACLE COVER FOR LATCHING PLUG

FIELD OF THE INVENTION

This invention relates to surface mounted, shielded electrical connectors of the type known as shielded miniature DIN connectors and concerns means for latching mating electrical connectors thereto.

BACKGROUND OF THE INVENTION

There is disclosed in U.S. Pat. No. 4,493,525, a first electrical connector having a circular cross-section first mating portion and a second electrical connector having a circular cross-section, shielded, second mating portion for receiving and mating with the first mating portion in a mating direction, the second mating portion having thereon a flexible latch arm provided with a protuberance proximate to its end, the first electrical connector having a latching shoulder provided in the insulating housing thereof, against which the protrusion can latch so as to retain the first and second mating portions in mating relationship. According to U.S. Pat. No. 4,493,525, the first mating portion is surrounded by a ring of spring fingers, projecting from a front shield of the first connector for resiliently engaging the shielding of said second mating portion when it is mated with the first mating portion. U.S. Pat. No. 4,548,455 discloses means for supporting such a latch arm when the connectors have been mated, so that the protuberance is secured in its latching position against a latching shoulder, said means being actable to release the arm, so that the protuberance can be depressed by the latching shoulder in order to allow the connectors to be unmated.

SUMMARY OF THE INVENTION

According to the present invention, the need for forming a latching shoulder in the housing of the first connector, where the first connector has a front shield from which spring fingers extend about the first mating portion, is avoided by providing intermediate a pair of the spring fingers on said shield, a rudimentary latching finger, that is to say a latching finger which is substantially shorter than the resilient fingers and behind which the protuberance latches when the first and second connectors have been mated. Where the second connector is provided with said means for supporting and releasing the latch arm, the latching finger and the protuberance are preferably provided with co-operating surfaces which are configured to allow the protuberance to slide under the latching finger when the latch arm has been released and the connectors are to be unmated. The latching finger is preferably rectilinear and extends obliquely towards the first mating portion, having a smooth surface facing towards the first mating portion, the protuberance having an arcuate surface to assist its depression by the latching finger, and a flat summit for sliding engagement with the flat surface of the latching finger.

The spring fingers may extend from the periphery of a circular opening in the front wall of a one-piece metal shield enclosing at least a top wall and side walls of the first connector which may have a substantially rectangular cross-section connector body into which the first mating portion projects, the latter having a mating face spaced back somewhat from the said front wall. The latching finger may very simply be provided, by forming the front wall, initially, only with the spring fingers and then severing one of the spring fingers to provide the latching finger.

BRIEF DESCRIPTION OF THE DRAWINGS

For a better understanding of the invention, and to show how it may be carried into effect, reference will now be made by way of example to the accompanying drawings in which.

DETAILED DESCRIPTION OF THE INVENTION

Figure 1:
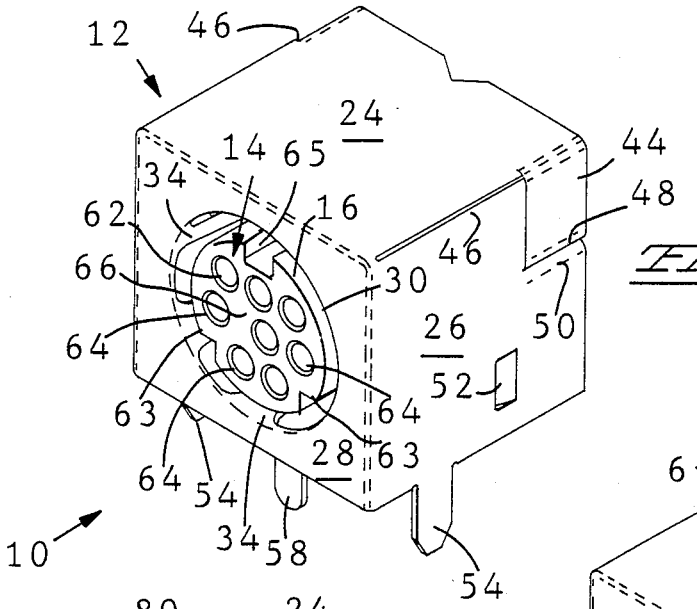
FIG. 1 is an isometric view of a shielded, surface mounted electrical connector having a metal shield.
Figure 2:
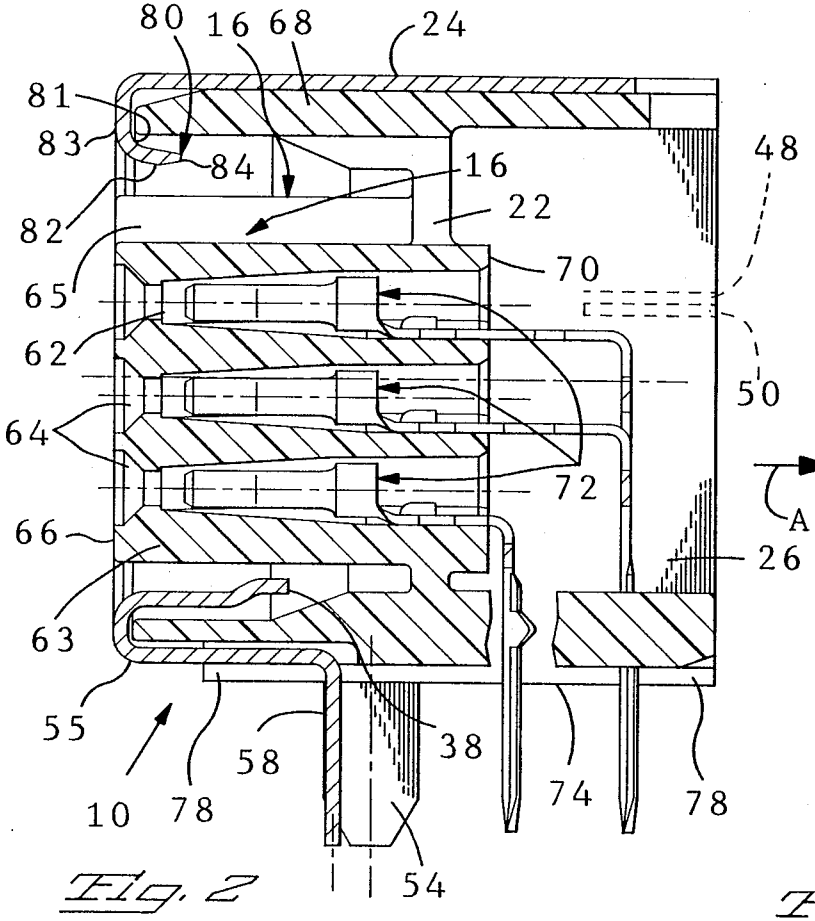
FIG. 2 is an axial sectional view of the connector of FIG. 1.

As shown in FIGS. 1 and 2, a shielded first electrical connector 10 for mounting on a substrate (not shown), for example a printed circuit board, comprises a one-piece metal shield 12 and a substantially rectangular cross-section, one-piece, molded, insulating connector body 14. There projects from the body 14, forwardly, therein, a circular cross-section mating member in the form of a plug portion 16 for mating with a mating member, in the form of a circular cross-section externally shielded, electrical socket 18 of a second electrical connector 20. The socket 18 has a metal shield 19, and electrical pins 17 projecting into the socket 18. As best seen in FIG. 2, the body 14 has a central portion 22 from which the plug portion 16 projects The shield 12 comprises a top wall 24, a pair of side walls 26, each adjacent thereto, depending from opposite lateral edges thereof. A front wall 28 adjacent to the top wall 24 and the side walls 26, is formed integrally therewith and has a circular, through opening 30 therein, for receiving the socket 18. The opening 30 has a circular edge 32 from which project a series of resilient, cantilever fingers 34 of the shield 12, rearwardly thereof, for engaging the external shield 19 of the socket 18, the fingers 34 being arranged in a ring about the edge 32 and being spaced from one another thereabout. Each finger 34 is formed with a joggle 40 spaced back from its free end 38 to provide a raised shoulder 42 for engaging the shield 19.

The shield 12 is provided with in-turned flanges 48 and 50 and with detents 52 which anchor it to the body 14. There depend from the side walls 26, mounting feet 54 and from an extension 55 of the front wall 28, mounting feet 58, the feet 54 and 58 being for securing the shield 12, and thus the body 14, to the said substrate. The plug portion 16 is formed with terminal receiving parallel cavities 62 which extend therethrough and also through the central portion 22 of the body 14 and open into a mating face 66 of the plug portion 16 and into a terminal receiving face 70 of the portion 22. The portion 22 has projecting forwardly therefrom a hood 68 surrounding the plug portion 16 in spaced relationship thereto, to allow the socket 18 to be mated therewith.

The plug portion 16 has an axial keyway 65 for slidably receiving a complementary key 67 in the socket 18. Each cavity 62 has secured therein an electrical receptacle 72 for receiving a respective one of the pins 17 of the socket 18. The body 14 has a bottom, mounting face 74 with stand-off lugs 78 for mounting on said substrate.

Figure 3:
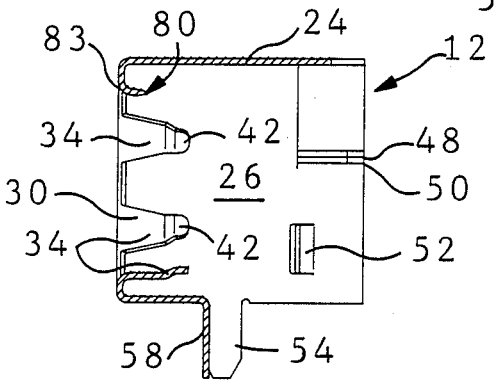
FIG. 3 is a reduced scale axial sectional view of the shield.
Figure 4:
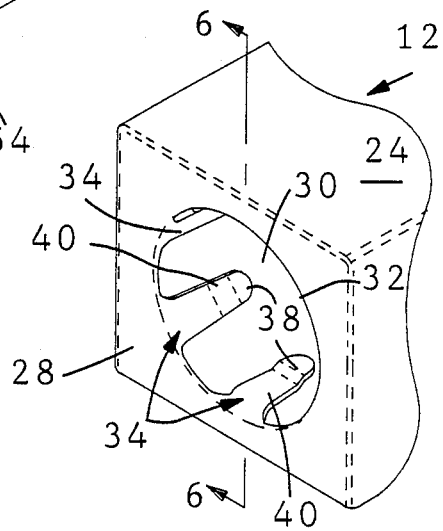
FIG. 4 is a fragmentary, isometric, enlarged, front view of the shield.

As shown in FIGS. 2 and 3, there projects inwardly and rearwardly of, the front wall 28 of the shield 12, a rudimentary latching finger 80, connected to the front wall 28 by way of a smoothly arcuate part 81 presenting a camming surface 83 bowed generally forwardly of the shield 12. The finger 80 projects slightly obliquely, towards the plug portion 16 and is substantially shorter than the fingers 34, being positioned between two of the fingers 34, and evenly spaced therefrom. The finger 80, which is of constant rectangular cross-section, has a flat surface 82 facing towards the plug portion 16 and terminates in a flat free end 84 which is perpendicular to the surface 82. The finger 80 is positioned diametrically opposite to the finger 34 shown in FIG. 6 at the bottom of the front wall 28 and which is therefore proximate to the mounting face 74. The shield 12 was initially formed with integral fingers 38 from the portion of surface 28 that otherwise would enclose opening 30 only, the top finger 38 then being severed, back from its joggle 40 to provide the latching finger 80.

Figure 5:
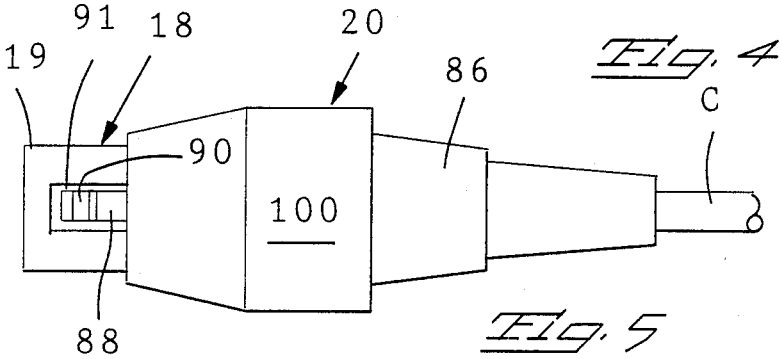
FIG. 5 is a top plan view, drawn to a reduced scale, of a shielded second electrical connector for mating with the connector shown in FIG. 1.

The second connector 20 (FIGS. 5 and 6) comprises an insulating body 86 within which the shield 19 extends from the socket 18 and which receives an electrical cable C, individual leads of which (not shown) are connected to respective connecting portions (not shown) of the pins 17. There extends from the body 86 into the socket 18, a resiliently flexible cantilever latch arm 88 having thereon proximate to its free end, a protuberance 90, projecting through an opening 91 in the shield 19 so that it is upstanding thereabove. The protuberance 90 has a first arcuate surface 92 facing rearwardly of the socket 18 and a second arcuate surface 94 facing forwardly thereof, the surfaces 92 and 94 adjoining a flat summit 96 of the protuberance 90. There is slidably mounted below the arm 88, a stiffly resilient support bar 98, which is connected to a slide (not shown) loaded by a spring (not shown) in the body 86 and which is in turn connected to a sleeve 100 slidably mounted on the body 86. The slide and thus the support bar 98 are normally urged towards an advanced supporting position beneath the arm 88, by the loading spring and can be retracted by pulling the sleeve 100 rearwardly of the body 86, to allow the arm 88 to flex freely downwardly into the socket 18, as disclosed in detail in U.S. Pat. No. 4,548,455, which is incorporated herein by reference.

Figure 6:
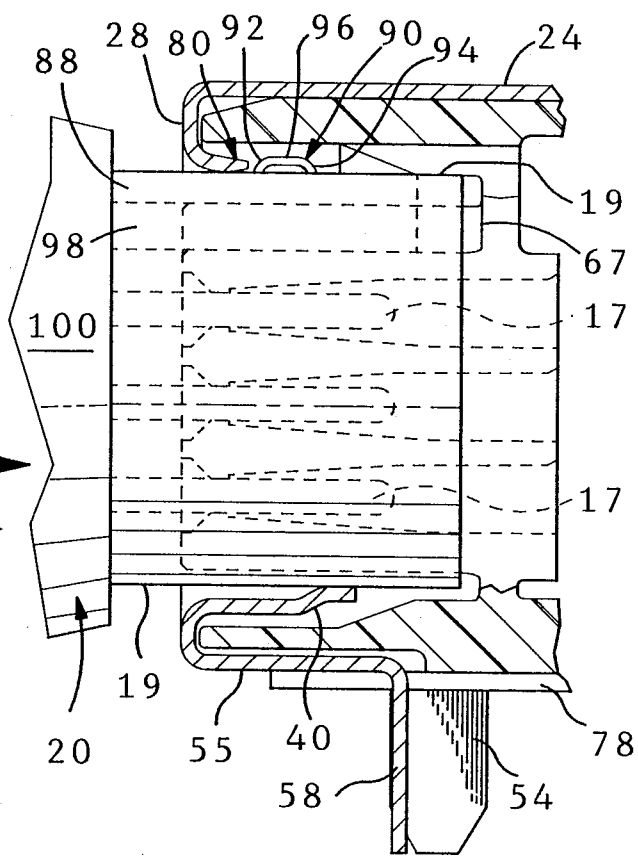
FIG. 6 is a diagramatic view taken on the lines 6—6 of FIG. 4, illustrating the second connector when it has been mated with the connector shown in FIG. 1.

In order to mate the first and second connectors, 10 and 20, respectively, the socket 18 is inserted through the circular opening 30 in the shield 12 so that the key 67 engages in the keyway 65, in a mating direction indicated by the arrow A in FIG. 6, whereby each pin 17 enters a respective cavity 62 so as to be engaged in the respective receptacle 72 in the cavity 62. The slide and thus the sleeve 100 are, prior to the mating operation, in said advanced position whereby the support bar 98 extends beneath the arm 88. Since the arm 88 has some flexibility, the socket 18 is permitted to advance into mating relationship with the plug portion 16 because the protuberance 90 is depressed by engagement of its surface 94 with the camming surface 83 of the rudimentary finger 80, against the resilient action of the support bar 98, the finger 80 being raised from the oblique position in which it is shown in FIGS. 2 and 3, onto the flat summit 96 of the protuberance 90. When the protuberance 90 has passed the free end 84 of the finger 80, the protuberance 90 resiles so as to latch there behind as shown in FIG. 6. The connectors 10 and 20 are accordingly firmly retained in mating relationship, because the arm 88, being supported by the support bar 98, cannot be depressed by the finger 80 simply by pulling on the cable C. When the connectors 10 and 20 are to be unmated, the sleeve 100 is pulled rearwardly thereby to retract the support bar 98 from beneath the arm 88, leaving the arm 88 free to flex inwardly of the socket 18. Thus as the connector 20 is pulled away from the connector 10, by pulling on the sleeve 100 and, the protuberance 90 guided by its surface 92, slips under the finger 80, the summit 96 of the protuberance 90 slides on the surface 82 of the finger 80 until the protuberance 90 passes the surface 92. The connectors 10 and 20 cannot be unmated by pulling on the cable C, as the sleeve 100 will not thereby be retracted.

We claim:

1. In combination, a first electrical connector having a circular cross-section first mating portion and a second electrical connector having a circular cross-section, shielded, second mating portion for receiving, and mating with, the first mating portion in a mating direction, the first mating portion being surrounded in spaced relationship by a metal shield formed with an opening providing access for said second mating portion to mate with the said first mating portion, cantilever spring fingers on the shield projecting from the periphery of said opening, inwardly of the shield, to engage the shielding on the second mating portion when it has been mated with the first mating portion, the said second mating portion having on its circular surface, a resiliently depressably protrusion, a rudimentary, resilient, cantilever latching finger having a free end projecting inwardly of the shield from said periphery to depress said protrusion as said first and second mating portions are being mated, the length of rudimentary finger being such that said protrusion resiles when the mating portions have been mated to assume a latching position behind the free end of the rudimentary finger, to latch said mating portions in their mated condition.

2. The combination claimed in claim 1, wherein the rudimentary finger extends from said periphery, in the mating direction, obliquely towards the first mating portion.

3. The combination claimed in claim 2, wherein the rudimentary finger is connected to the shield by way of a smoothly arcuate part for camming engagement with said protrusion, the rudimentary finger having a flat surface between said arcuate part and the free end of the rudimentary finger.

4. The combination claimed in claim 3, wherein the protuberance has a first arcuate surface for co-operation with said smoothly arcuate part for initial depression of the protuberance, and opposite to the first arcuate surface, a second arcuate surface for engagement behind the free end of said rudimentary finger, said free end being perpendicular to said flat surface, said rudimentary finger being substantially shorter than said spring fingers.

5. The combination claimed in claim 3, wherein said protuberance has a first arcuate surface for co-operation with said arcuate part, for initially depressing the protuberance and a second arcuate surface opposite to the first arcuate surface for engagement with the free end of said rudimentary finger, said arcuate surfaces adjoining a flat summit of the protuberance.

6. The combination claimed in claim 1, wherein the protuberance is carried by a flexible arm beneath the shielding of the second mating portion and projects through an opening therein, a stiffly resilient support bar in the second mating portion being movable between an advanced position to resiliently support said arm and a retracted position, in which said arm is free to flex inwardly of the second mating portion, said rudimentary finger, being connected to said shield by way of an arcuate camming part for depressing said protuberance against the supporting action of said support bar.

7. The combination claimed in claim 6, wherein the free end of the rudimentary finger is adapted to depress the protuberance, in the retracted position of the support bar to allow said mating portions to be unmated from their mating condition, the rudimentary finger having a flat surface between said arcuate part and said free end to allow the protuberance to slide beneath the rudimentary arm.

8. The combination claimed in claim 7, wherein the protuberance has opposite arcuate surfaces for camming co-operation with said arcuate part and said free end, respectively, and a flat summit for sliding co-operation with said flat surfaces.

9. A surface mounted electrical connector comprising a connector body having a bottom surface for mounting on a substrate into which body projects forwardly, a circular cross-section first mating member for mating with a shielded circular cross-section mating member; and a front shield having means for securing it to said body, and a circular opening providing access for said second mating member to mate with said first mating member, a ring of cantilever spring fingers projecting from the periphery of said opening and extending about said first mating member for resilient engagement with the shielding of said second mating member when mated with said first mating member, a cantilever latching finger also projecting from said periphery between a pair of spring finger and being substantially shorter than said spring fingers, the latching finger extending obliquely towards said first mating member, the latching finger being connected to said periphery by way of a smoothly arcuate camming part bowed in the outward direction of said opening for depressing a resilient protrusion on said second mating member, the latching finger having a flat surface for engaging a flat summit of said protrusion and a flat free end for engaging behind said protuberance, said flat surface facing towards said mating member and extending between said arcuate camming part and said flat free end, each of said spring fingers having a joggle spaced back from its free end and being positioned beyond said flat free end of the latching finger in a direction away from the front shield.

10. A one piece metal shield for a surface mounted electrical connector, the shield comprising;

a top wall; a pair of shield side walls adjacent to the top wall and depending from opposite lateral edges thereof;

a shield front wall adjacent to the shield top wall and to the shield side walls and having a circular, through, opening therein, said opening having a circular edge, a series of cantilever spring fingers spaced from each other about said opening and projecting from said edge into said shield and;

a cantilever latching finger, which is shorter than said spring fingers projecting from said edge between a pair of the spring fingers, the latching finger being of constant rectangular cross-section and having a flat free end and being connected to said edge by way of a smoothly arcuate part presenting a camming surface bowed in the outward direction of said opening, a flat surface of said latching finger extending from said arcuate part unto said flat free end at right angles thereto and facing in the inward direction of said edge, each cantilever spring finger having a joggle spaced back from the end thereof and being positioned beyond said free end of the latching finger in the rearward direction of said front wall.

* * * * *